US005452496A

United States Patent [19]

Long et al.

[11] Patent Number: 5,452,496

[45] Date of Patent: Sep. 26, 1995

[54] VACUUM ASSISTED ACCUMULATOR AND PROCESS OF COLLECTING MICROFIBER

[75] Inventors: James M. Long, Toledo; Timothy M. Nijakowski, Swanton, both of Ohio

[73] Assignee: Schuller International, Inc., Denver, Colo.

[21] Appl. No.: 191,407

[22] Filed: Feb. 3, 1994

[51] Int. Cl.[6] ..... D01G 27/04; B65H 18/26

[52] U.S. Cl. ..... 19/308; 242/532.2; 242/581

[58] Field of Search ..... 19/286, 296, 288, 19/304, 308, 149; 242/532.2, 542.3, 581; 65/453, 475; 162/283

[56] References Cited

U.S. PATENT DOCUMENTS

| | | | |
|---|---|---|---|
| 3,066,358 | 12/1962 | Schiess | 19/296 X |
| 3,106,356 | 10/1963 | Lee et al. | 242/532.2 X |
| 3,131,615 | 5/1964 | Schur | 242/532.2 X |
| 4,133,495 | 1/1979 | Dowd | 242/532.2 |
| 4,487,377 | 12/1984 | Perini | 242/532.2 X |
| 4,609,162 | 9/1986 | Kataoka | 242/542.3 X |
| 4,611,638 | 9/1986 | Matumura | 242/581 X |

*Primary Examiner*—John J. Calvert
*Attorney, Agent, or Firm*—Cornelius P. Quinn

[57] ABSTRACT

A method and apparatus for accumulating and densifying microfibers such as glass fibers having mean fiber diameters below 1–2 microns is disclosed. A fine fiber blanket having been collected on a collection surface is removed and wound up on a mandrel having a permeable surface while a partial vacuum, preferably exceeding one hundred inches of water column, is maintained in the interior of the mandrel.

10 Claims, 3 Drawing Sheets

VACUUM ASSISTED ACCUMULATOR AND PROCESS OF COLLECTING MICROFIBER

BACKGROUND OF THE INVENTION

It is known to make fine glass microfibers having mean fiber diameters below about two microns, and even below one micron, as disclosed in U.S. Pat. No. 4,167,404, which disclosure is hereby included by reference.

In that process glass rods or primaries are remelted and attenuated into very fine fibers having mean fiber diameters below about two microns by high impact jet blasts created by air-gas burners. The fine fibers are entrained in the gaseous stream and are removed by pulling the air through a moving screen where the fibers remain and build up to form a thin blanket while the gases pass through the screen and are exhausted. The blanket of fiber on the moving screen is passed between seals into a zone where there is ambient pressure or positive pressure underneath the screen allowing the fiber to be removed from the screen and wound up on a mandrel. Some densification of the fiber blanket takes place as the blanket winds up on the mandrel due to the weight of the mandrel, and optionally a composting roller, but the blanket is not densified to the extent desired. An optional compacting roller or a weighted mandrel are normally used to increase the density of the fiber roll or mass. However, this extra force applied to the mandrel becomes heavy, or the resultant force causes the collection surface to be deformed and the collection drum to become deformed resulting in high maintenance.

BRIEF DESCRIPTION OF THE INVENTION

The present invention involves a method of applying equal or greater forces on a thin fiber blanket to compact it while the blanket is being wound on a mandrel, without also applying this force to the original fiber collection surface. The windup mandrel is modified to have a permeable circumferential surface and a partial vacuum is applied to its interior which causes a large force to be put on the fiber blanket while adding no additional force to the collection or transfer surface that the mandrel and wound up blanket are running against.

The low permeability of fine microfiber masses provides sufficient resistance to air flow to cause high pressure drops across the layer or mass of microfiber being wound up which is essential to the practical application of the present invention. Thus if the mean diameter of the fibers is much above 1 micron and as much as about 2 microns, insufficient resistance is present in the fiber mass to generate adequate pressure drop.

DETAILED DESCRIPTION OF THE PRIOR ART

Figure 1:
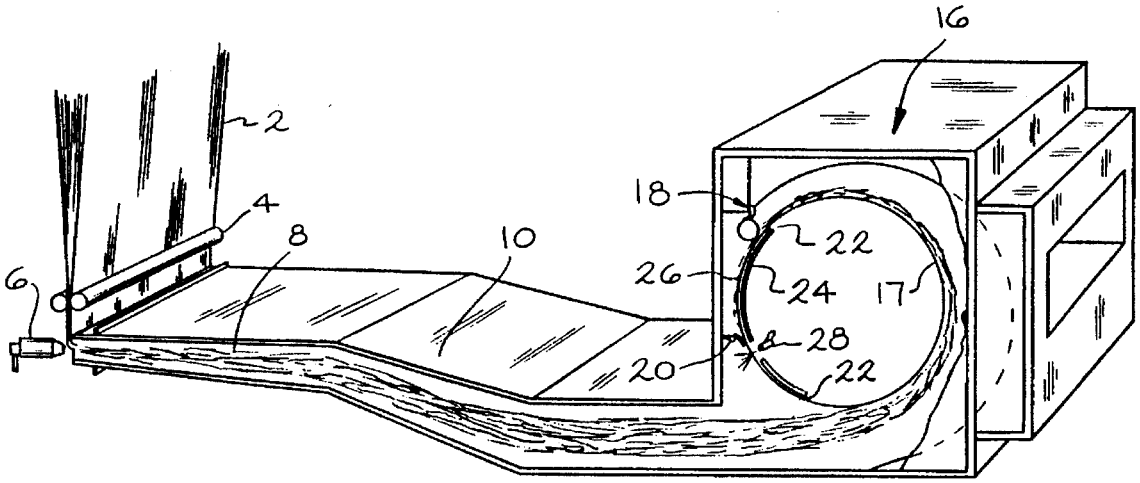
FIG. 1 PRIOR ART
FIG. 1 shows a prior art fine fiber making system like that disclosed in U.S. Pat. No. 4,167,404 (FIG. 6).

FIG. 1 shows a prior art fiber making and collection system. In this system a plurality of coarse primaries or rods 2 of thermoplastic material such as glass are fed continuously by pull rolls 4 into one or more hot gaseous blasts or jets created by one or more air-gas burners 6. The primaries are melted and attenuated into fine fibers 8 having a mean fiber diameter below about 2 microns, usually below 1 micron, and as low as a few tenths of a micron, e.g., 0.2, 0.4, 0.65, 0.8, 1.0, 1.2, 1.5, etc. The fibers 8 are carried along with a duct 10 by the gases from the gaseous blast and any additional air inspirated by the high velocity jet to a chamber 16 and on to a permeable collection surface 17, in the form of a drum rotating about a horizontal axis, by a force created by maintaining a partial vacuum in the interior of the collection drum. The circumferential surface 17 of the drum can be made of a honeycomb structure with fine woven wire fabric covering the surface or perforated metal sheet either alone or covering a honeycomb structure. As the gases are pulled through the rotating permeable drum, fibers collect on the surface 17 forming a thin fibrous blanket. As the drum rotates, the blanket passes beneath a roller and seal 18 to a point 26 where the blanket is to be removed. Seals 20 and 18 prevent ambient air from leaking into chamber 16. Seals 22 and plate 24 create a "dead" zone or neutral pressure zone in the region 26 where the fiber blanket is to be removed from the drum 17. High pressure air jets 28 blow air through the permeable surface removing any fiber that may be lodged in the screen, perforated metal, etc.

Figure 2:
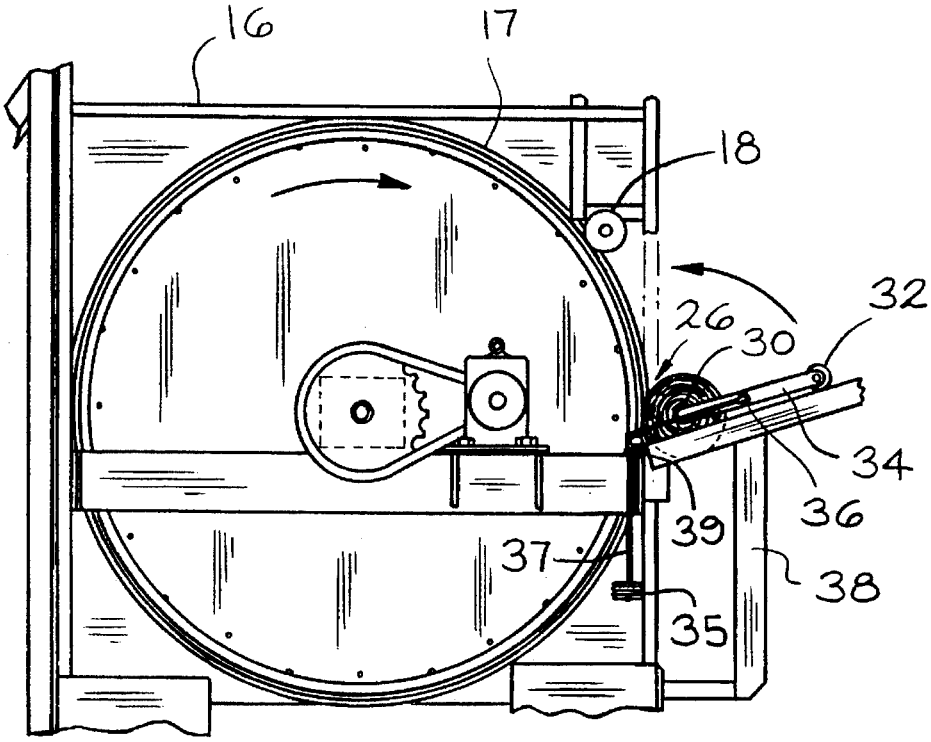
FIG. 2 PRIOR ART
FIG. 2 shows a prior art fiber blanket removal and wind up apparatus like that shown in U.S. Pat. No. 4,167,404.

As shown in FIG. 2, the fiber blanket is removed from the drum at point 26 by a mandrel 30, or alternately 32, that rotates from being in contact with the rotating drum. To start, the fiber blanket is pulled away from the surface 17 after it passes beneath mandrel 30 and is then wrapped around the mandrel and tucked into the nip formed by the mandrel and the fiber blanket still on the drum surface 17. The rotating mandrel 30 then continues to remove and wrap up the fiber blanket. The mandrel 30 is pivotly or otherwise supported by arms 34 and pins 36 supported by member 38. Preferably the mandrel 30 is held in such a manner that very little additional force is exerted against the drum as the fiber roll is formed. While this is helpful to the alignment and bearings of the drum, it unfortunately produces loose and very bulky rolls which are impractical. It has been necessary to apply compacting force to the mandrel and wound blanket or fiber mass by the use of weights 35 which exert substantial force on the winding mandrel through cables 37 running over pulleys 39 and attached to arms 34. This force deforms the collection surface and drum resulting in high maintenance.

DETAILED DESCRIPTION OF THE INVENTION

Applicants have now discovered a way to wrap tighter, denser rolls of microfiber blanket without putting any additional weight or force onto the fiber collecting drum. This is accomplished by using a rotating mandrel that has a permeable circumferential wall and a partial vacuum in its interior.

Figure 3:
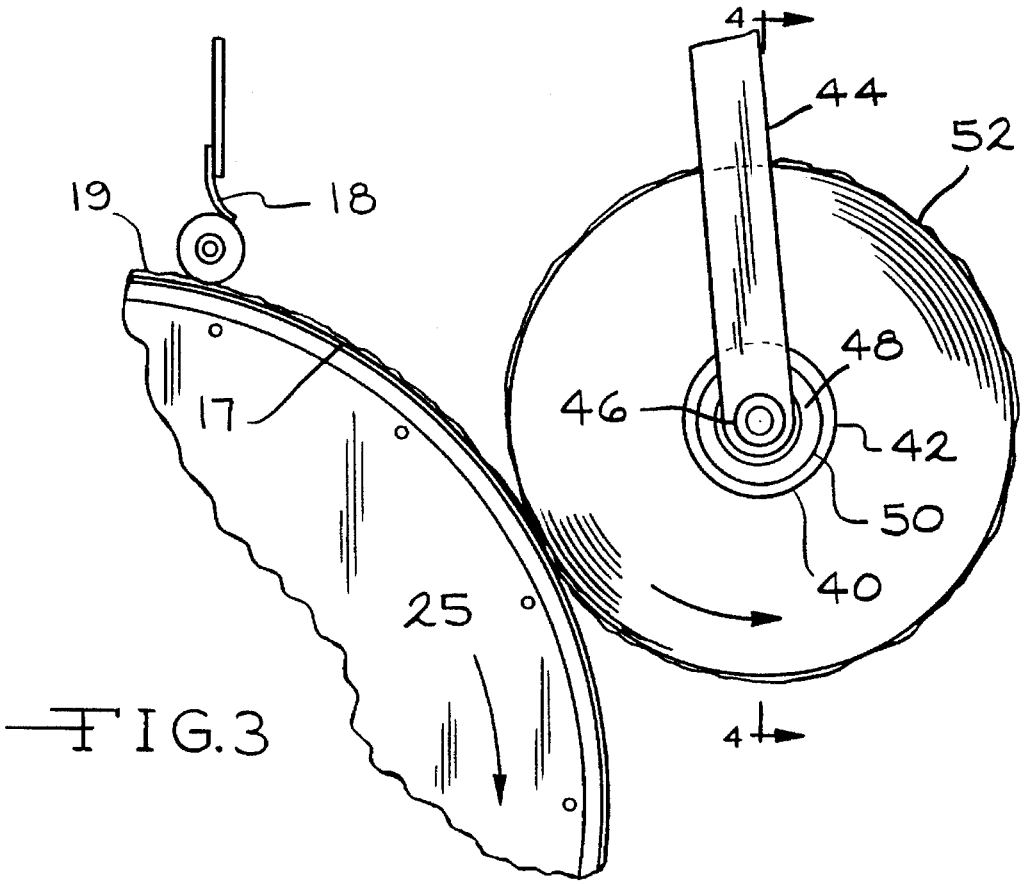
FIG. 3 is a side view of the present invention shown with the fiber collection system disclosed in U.S. Pat. No. 4,167, 404.

FIG. 3 shows a side view of this improved microfiber blanket removal and windup device used in combination with the microfiber making system of U.S. Pat. No. 4,167, 404. A microfiber blanket 19, formed by collecting fibers on the permeable collection surface 17 in a known manner, passes under the seal assembly 18 and into a "dead" zone 25, i.e., a zone where there is no pressure drop across the fiber blanket and the collection surface making it easier to remove the fiber blanket from the collection drum. Seal assembly 18, cooperating with another member and seals inside the drum as disclosed in U.S. Pat. No. 4,167,404 create the "dead" zone 25.

A rotatable mandrel 40 having a permeable surface and wall 42 is pivotly supported by arms 44, one beyond and near each end of the mandrel 40 and rigidly attached to a horizontal perforated pipe manifold 46, such as by welding or preferably with the use of split shaft collars welded to the arms in a known manner to allow the mandrel to be easily removed from the arms. The mandrel 40 rotates around the perforated pipe manifold 46, whose horizontal axis is also the horizontal axis of the mandrel 40, with the aid of ball bearings 48. Perforations (47 in FIG. 4) in the manifold 46 are distributed along its length in a known manner to provide a reasonably consistent level of partial vacuum along the mandrel length. As the mandrel 40 rotates it winds the fiber blanket to form a fiber roll 52.

The permeable wall 42 can be a perforated metal sheet such as 16 gauge carbon steel with 0.079 inch diameter holes on one eighth inch centers having 36% open area and preferably hard chrome plating on its surface. Other types of permeable material can be used, e.g., different hole sizings, spacings, patterns, etc. The mandrel is supported at each end by hoops 50 which in turn engage the ball bearings 48. The other ends of arms 44 are pivotly mounted at a point not shown, by on the collection system frame at a location to provide only a slight bias towards the collection drum. This arrangement exerts a minimum amount of force on the collection drum.

Figure 4:
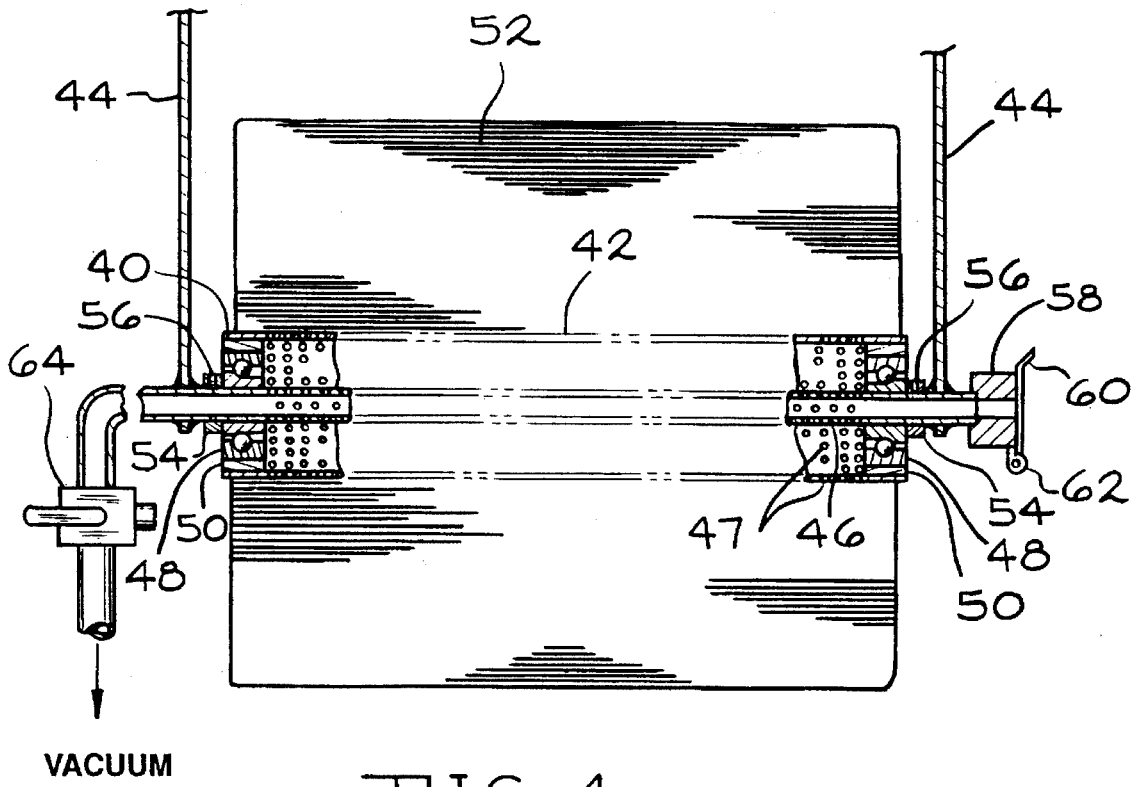
FIG. 4 is a view taken along lines 4—4 of FIG. 3.

As shown in FIG. 4, which is a cross-sectional view of the blanket removal and wind up assembly looking in the direction of arrows 4—4 in FIG. 3, collars 54 snugged onto the manifold 46 by set screws 56 hold the mandrel 40 in place. On the extreme end of manifold 46 and outside arms 44 is attached a flapper valve 58 which can be a valve like those used in the outlets to a central vacuum cleaning system. Valve 58 has a flapper 60 pivotly mounted to the body of valve 58 by pin 62. The flapper 60 is held shut and sealed by the vacuum in manifold 46, but can be easily and quickly opened to greatly reduce the vacuum level in manifold 46. On the opposite end of manifold 46 a manual shut off valve 64 can be optionally installed to stop all air flow out of manifold 46 and to return the interior of mandrel 40 to atmosphere pressure.

Figure 5:
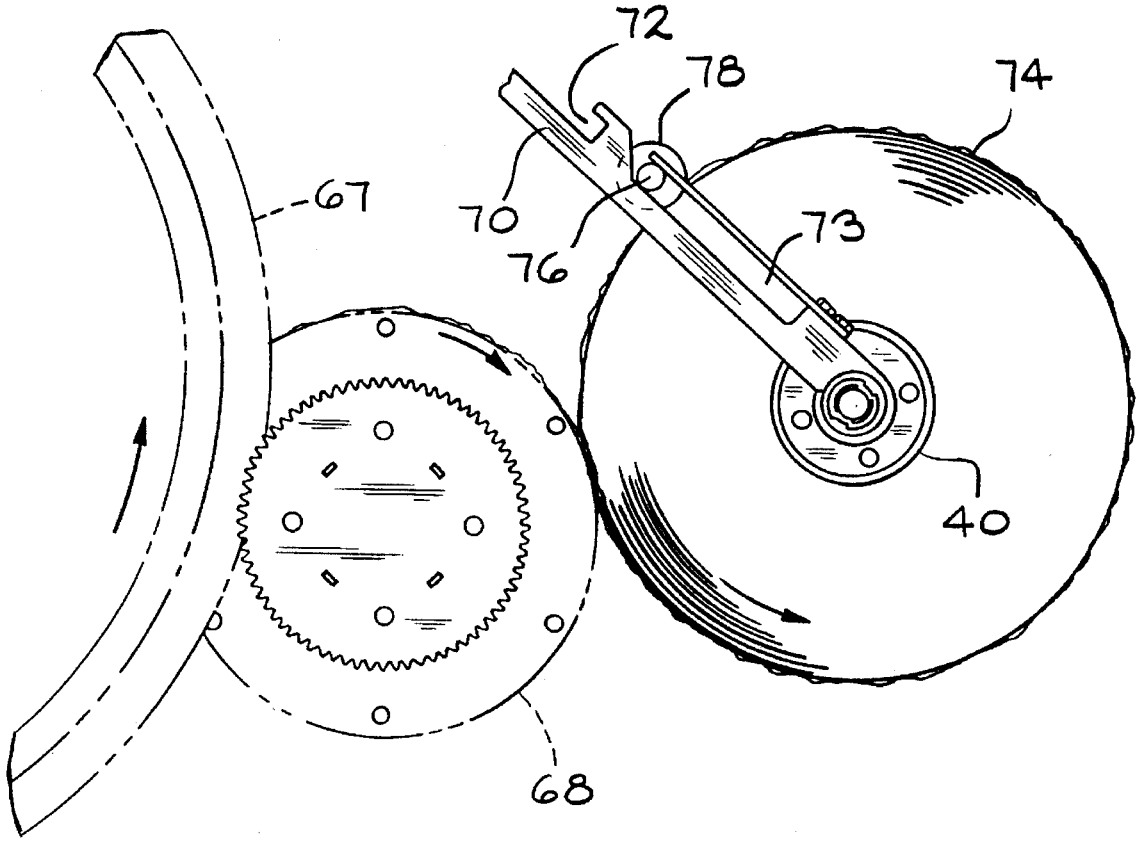
FIG. 5 shows a side view of the wind up of the present invention being used with a fiber collecting apparatus disclosed in U.S. patent application Ser. No. 08/191,406, titled METHOD AND APPARATUS FOR ACCUMULATING A FIBROUS MASS, the inventors being J. Michael Long, Daniel Kepling and Timothy M. Nijakowski, which application was filed on the same date as the present application.

FIG. 5 shows the invention being used with a different collection system. In this system the fiber blanket is removed from collection drum 67 with a blanket removal roll 68 having a structure like the mandrel 40 shown in FIGS. 3 and 4 except also having an internal baffle (now shown here) that limits the partial vacuum inside the permeable circumferential wall of the roll 68 to the zone just prior to, and extending about 60–90 radial degrees past the place where the blanket is removed from the drum. The mandrel 40 of this invention rides on the surface of roll 68, removing the blanket and winding it up while exposed to a partial vacuum through the perforations in sheet 42.

In this embodiment roll 68 is rigidly supported axially and will not exert any additional force on drum 67 if additional force is exerted on roll 68. To wind the fiber blanket under additional load, which can be safely done in this embodiment, to produce a denser fiber roll, arms 70, which are pivotly mounted on the ends not shown, contain a short open slot 72 and a longer open slot 73 which can hold the axle 76 of a heavy roller 78 that presses against and turns on the fiber roll 74. Slot 72 is for holding roller 78 while fiber roll 74 is being removed from the mandrel 40, or to hold roller 78 off of roll 74 when that is desirable.

The mandrel shown in FIGS. 3 and 4 can also be used to remove and wind microfiber blanket that is collected on a permeable conveyor chain, which is an old way of collecting or transferring fibers, by simply biasing mandrel 40 slightly against a "dead" zone of the conveyor chain.

To use the invention described above, microfibers are made and collected in a known manner to form a fibrous blanket. The mandrel 40 is biased against a dead zone of the moving fiber blanket. After the new leading edge or end of the fiber blanket passes the mandrel 40, it is wound around the mandrel surface 42 and tucked into the nip formed by the surface 42 and the moving fiber blanket still on the drum, while the mandrel interior is connected to a vacuum source having a capability of at least one hundred inches and preferably at least two hundred inches of water column. A suitable vacuum pump to use is a lobe pump with a five horsepower motor, such as a Dresser-Roots Model 42 URAI manufactured by the Roots Division of Dresser Industries, Connersville, Ind.

When using the system shown in FIG. 5, a heavy roller, such as a one-two inch diameter steel roller with a one-half inch diameter axle, can be placed in slots 73 of arms 70.

As the roll builds the resistance to flow of air through the thickness of the fiber roll increases, resulting in a pressure drop of up to two hundred inches or more of water from the outside diameter to the inside diameter of the fiber roll. This pressure drop, and the atmospheric pressure it represents, packs the fiber layers together very tightly making a denser roll or mass of fiber without applying any additional load, to the collection drum or surface. Since microfiber blanket is very bulky and low in density, tighter packing and higher density rolls are important to minimize handling costs.

With this invention the forces are exerted continuously over the entire fiber roll, whereas, in the prior art the compaction forces were exerted on only a portion of the roll at any time and there was a continuous progressive compressing and partial decompressing of the fiber mass causing the fibers to rub together and damage each other at times. If desired, when using the embodiment of FIG. 5, a pressure roll can be used in conjunction with the present invention to form a slightly denser roll. In this latter instance, the flexing of the fiber blanket by the pressure roller is greatly reduced because the fiber blanket is first greatly compressed and later held to a high density by the partial vacuum in mandrel 40.

After a roll of microfiber reaches a certain diameter, depending on the fiber diameter distribution, the maximum pressure drop through the roll layer is reached and at or near this time the fiber roll should be removed from the mandrel 40. To do that, the flapper 60 on the extension of the manifold 46 is opened and left open. The layer of the fiber roll is cut clear through all along its length using a sharp long bladed knife and the fiber roll is removed from the mandrel 40. The flapper 60 is closed and the fiber blanket of the collection drum is restarted onto mandrel 40 as described above.

The fiber rolls made with the disclosed invention will expand some after being cut and removed from the mandrel 40. These rolls can be compression baled to further densify and to form a larger package if desired using known baling equipment and techniques. The rolls can also be opened up and flattened out prior to baling if desired. The denser rolls made by this invention make denser bales and reduce roll and bale handling costs in the manufacturing plant, enroute, and in the customers plant.

We claim:

1. In an apparatus for separating microfiber from a gaseous stream, collecting said microfiber into a permeable blanket and winding and densifying said blanket into a dense roll, said microfiber having a mean diameter below about 2 microns, comprising:

a movable and permeable collection surface for collecting said microfiber into a blanket and for advancing said blanket, a freely rotatable mandrel having an outer circumferential wall for winding up said blanket, said circumferential wall being biased towards said permeable collection surface, the improvement comprising, a partial vacuum source, said mandrel having an interior, said outer circumferential wall of said mandrel being permeable and being minimally biased towards said collection surface, and wherein said vacuum source is connected to said interior of said rotatable mandrel to pull air through said permeable outer wall of said mandrel as the blanket is wound up on said mandrel so as to form a dense multilayered roll, the partial vacuum source having a capacity to generate and maintain at least about 100 inches of water column in the blanket adjacent to said mandrel.

2. The apparatus of claim 1 wherein said outer circumferential wall of said mandrel is in contact with said collection surface.

3. The apparatus of claim 1 wherein said capacity of said pump is at least about 200 inches of water column.

4. The apparatus of claim 3 further comprising a blanket removal roll having a permeable outer circumferential wall which is biased against said collection surface and wherein said mandrel is biased against the outer circumferential wall of said blanket removal roll.

5. The apparatus of claim 4 further comprising a compacting roller biased against said outer circumferential wall of said mandrel, the axis of said compacting roller being generally parallel with the axis of said mandrel, said compacting roller being free to move away from said outer wall of said mandrel as material is wound up on said mandrel.

6. In a method of collecting microfibers, having a mean fiber diameter of less than about two microns, into a blanket on a moving permeable collection surface, removing said blanket from said surface and winding said blanket onto a mandrel while densifying said blanket to form a dense multilayered roll and removing said dense roll from said mandrel, the improvement comprising using a mandrel having a permeable outer circumferential wall and subjecting said blanket adjacent to said mandrel wall to a partial vacuum of at least about 100 inches of water column while winding said blanket to form said dense roll.

7. The method of claim 6 wherein said blanket is removed from the collection surface by only slightly biasing said mandrel against the fiber blanket while blanket lies on said collection surface.

8. The method of claim 6 wherein said blanket is removed from the collection surface by a transfer roll and said blanket is removed from said transfer roll by said mandrel and wherein a compacting roller is made to rotate on the roll of densified fiber while said fiber roll is being formed resulting in a still denser fiber roll.

9. The method of claim 6 wherein a partial vacuum of up to at least two hundred inches is exerted on the blanket adjacent the outer circumferential surface of said mandrel.

10. The method of any one of claims 6–9 wherein the microfibers are glass fibers having a mean fiber diameter of less than one micron.

* * * * *